United States Patent [19]

Mastrobuoni

[11] Patent Number: 4,836,410

[45] Date of Patent: Jun. 6, 1989

[54] DISPENSABLE TOWELS AND THEIR RELATING CONTAINER

[76] Inventor: Alma Mastrobuoni, 6 Via Roccolo, Lecco (Como), Italy, 22053

[21] Appl. No.: 72,523

[22] Filed: Jul. 13, 1987

[30] Foreign Application Priority Data

| | | | |
|---|---|---|---|
| Jul. 15, 1986 | [IT] | Italy | 22523/86[U] |
| Jul. 15, 1986 | [IT] | Italy | 21129 A/86 |
| May 5, 1987 | [IT] | Italy | 20377 A/87 |

[51] Int. Cl.[4] ..... A47K 10/24

[52] U.S. Cl. ..... 221/47; 221/63

[58] Field of Search ..... 221/63, 50, 47, 55, 221/41, 33; 206/515

[56] References Cited

U.S. PATENT DOCUMENTS

| | | | |
|---|---|---|---|
| 1,977,687 | 10/1934 | Medoff | 221/63 |
| 2,761,676 | 9/1956 | Sabee et al. | 221/50 |
| 2,923,435 | 2/1960 | Chaplin | 221/47 |
| 3,286,879 | 11/1966 | Philippon | 221/63 X |
| 4,064,880 | 12/1977 | Logan | 221/47 X |
| 4,362,623 | 12/1982 | Holopainen | 206/515 X |
| 4,648,510 | 3/1987 | Kuenzel | 221/47 X |

FOREIGN PATENT DOCUMENTS 0126362 11/1984 European Pat. Off. .

*Primary Examiner*—F. J. Bartuska

*Attorney, Agent, or Firm*—Lerner, David, Littenberg, Krumholz & Mentlik

[57] ABSTRACT

Dispensable sanitary towels for storage in a container dispenser having a wall defining a slot area through which the towels are dispensed, the towels being imbued with one or more substances selected from the group consisting of disinfectants, deodorizers and detergents, and folded lengthwise and traversely, the traversed fold providing two horizontally superposed layers the edges of which are offset from each other, wherein the towels are capable of being stacked independently in the container with one of the offset edges of the towel to be dispensed retained by the wall defining the slot area and the other offset edge located in the slot area and provided with two protruding parts, the protruding parts being located on the same side of the open towel.

8 Claims, 3 Drawing Sheets

Fig. 1
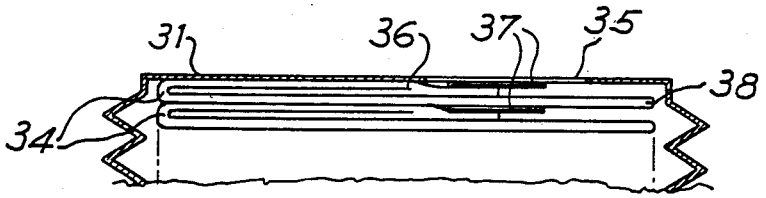
Fig. 2
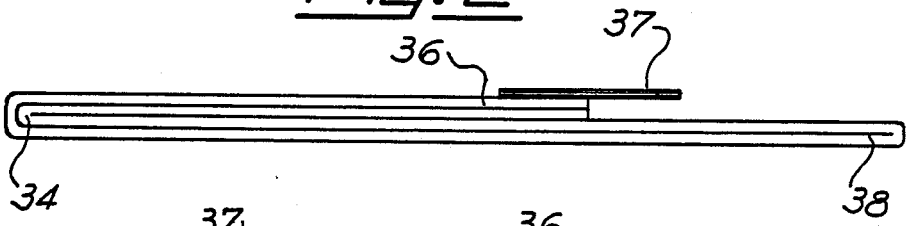
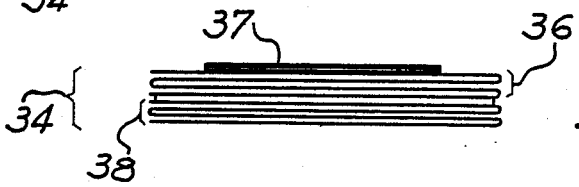
Fig. 3
Fig. 4
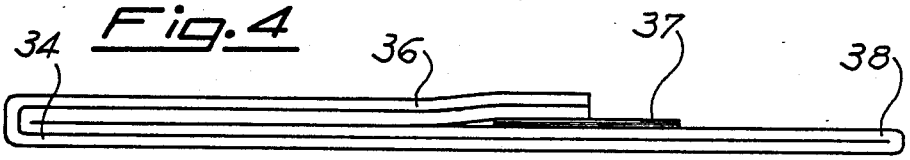
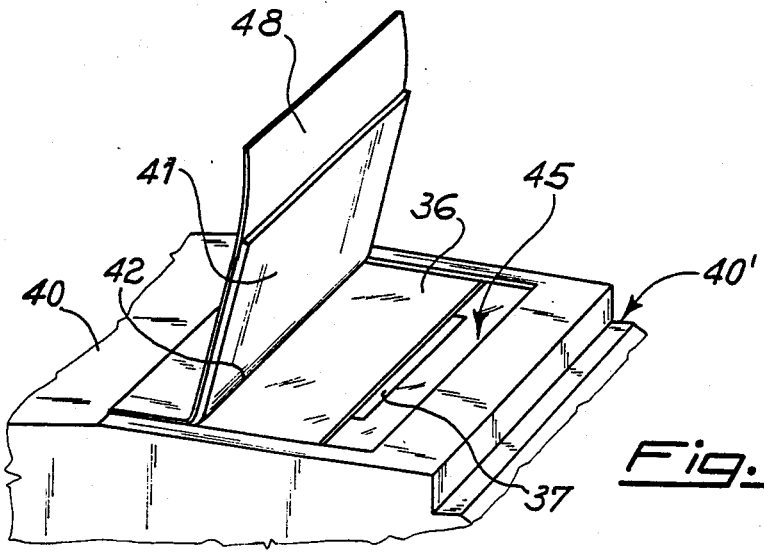
Fig. 5

DISPENSABLE TOWELS AND THEIR RELATING CONTAINER

BACKGROUND OF THE INVENTION

1. Field of the Invention

The present invention concerns a method for the production of dispensable handkerchiefs or sanitary towels, particularly of the kind imbued with disinfectant, deodorizing and/or detergent substances.

The invention also concerns a towel obtained according to said method, and a container-disperner for such towels.

2. Description of the Prior Art

Several kinds of handkerchiefs or sanitary towels imbued or wetted with a detergent or disinfectant liquid are presently known; such towels are packed in many different kinds of containers, which generally are made of rigid and indeformable plastic, thus being too bulky to be carried in a pocket, in a handbag or the like. Moreover such containers do not reduce their dimensions with the reduction of the number of towels they contain, thus causing the evaporation of the liquid wetting the last towels in the surrounding air therein contained.

Such disadvantages (and some others of a more technical nature) were solved by means of successive realizations such as those disclosed in the European Patent Specification No. 0030348 in the name of Nakamura, and in the European Patent Application No. 0126362 in the of Mastrobuoni. Both said patents provide a pocket container-dispenser for sanitary towels, wherefrom said towels are extracted through a slot which can be airtightly closed.

The towels contained in such dispensers are stacked independently from one another; this disposition eliminates the prior disadvantages, but, the towels being wetted, it causes a noticeable difficulty in extracting the towels from the dispensing slot and in unfolding them, because the folded towel edges are sticking together and to the underlying towel.

SUMMARY OF THE INVENTION

An object of the invention is to solve the cited problems by providing a disposable towel which can be easily extracted from its container and unfolded in an open condition. Another object of the invention is to provide a method for producing disposable towels imbued with a disinfectant, deodorizing and/or detergent substances and stacked independently from one another in a dispenser-container, which are easily extracted from said container and unfolded in an open condition.

More particularly the invention concerns a method for producing dispensable handkerchiefs or sanitary towels, of the kind comprising folding each towel with at least two horizontally superposed layers so that the edges of said towel are offset from each other; stacking said towels independently from one another; imbuing said towels with disinfectant, deodorizing and/or detergent substances and packing them in a container-dispenser having a slot positioned in the wall adjacent to the first towel wherethrough said towels are extracted, said container-dispenser having also means for positioning said stacked towels against said slot so that one towel edge is located in the area of the slot while the other towel edge is retained by the wall area surrounding the slot, characterized in that on each towel is applied or inserted a rigid or semirigid layer of a non-adhesive material, said layer being applied on at least one area of said towel which is corresponding to the cited slot area.

The invention also concerns a dispensable handkerchief or sanitary towel of the kind imbued with disinfectant, deodorizing and/or detergent substances; said towel being folded in at least two horizontally superposed layers so that the edges of said towel are offset from each other, and being stacked independently from the other towels in a container-dispenser having a slot positioned in the wall adjacent to the first towel of said stack, wherethrough said towels are extracted, said container-dispenser having also means for positioning said stacked towels against said slot so that one towel edge is located in the slot area while the other towel edge is retained by the wall area surrounding said slot, characterized in that each towel has at least one defined area consisted on an applied or inserted rigid or semirigid layer of a non-adhesive material.

Other characteristics of the method and the towels according to the invention will be now better described by way of illustrative and non-limiting examples with reference to the accompanying drawings, wherein:

BRIEF DESCRIPTION OF THE DRAWINGS

FIG. 1 is a side cross view of two towels according to the invention in a dispenser;

FIG. 2 is an enlarged side view of a towel of FIG. 1;

FIG. 3 is a front view of FIG. 2 embodiment;

FIG. 4 is a side view of another towel according to the invention;

FIG. 5 is partial perspective view of the slot area of a dispenser according to the invention;

DESCRIPTION OF THE PREFERRED EMBODIMENT

Figure 6:
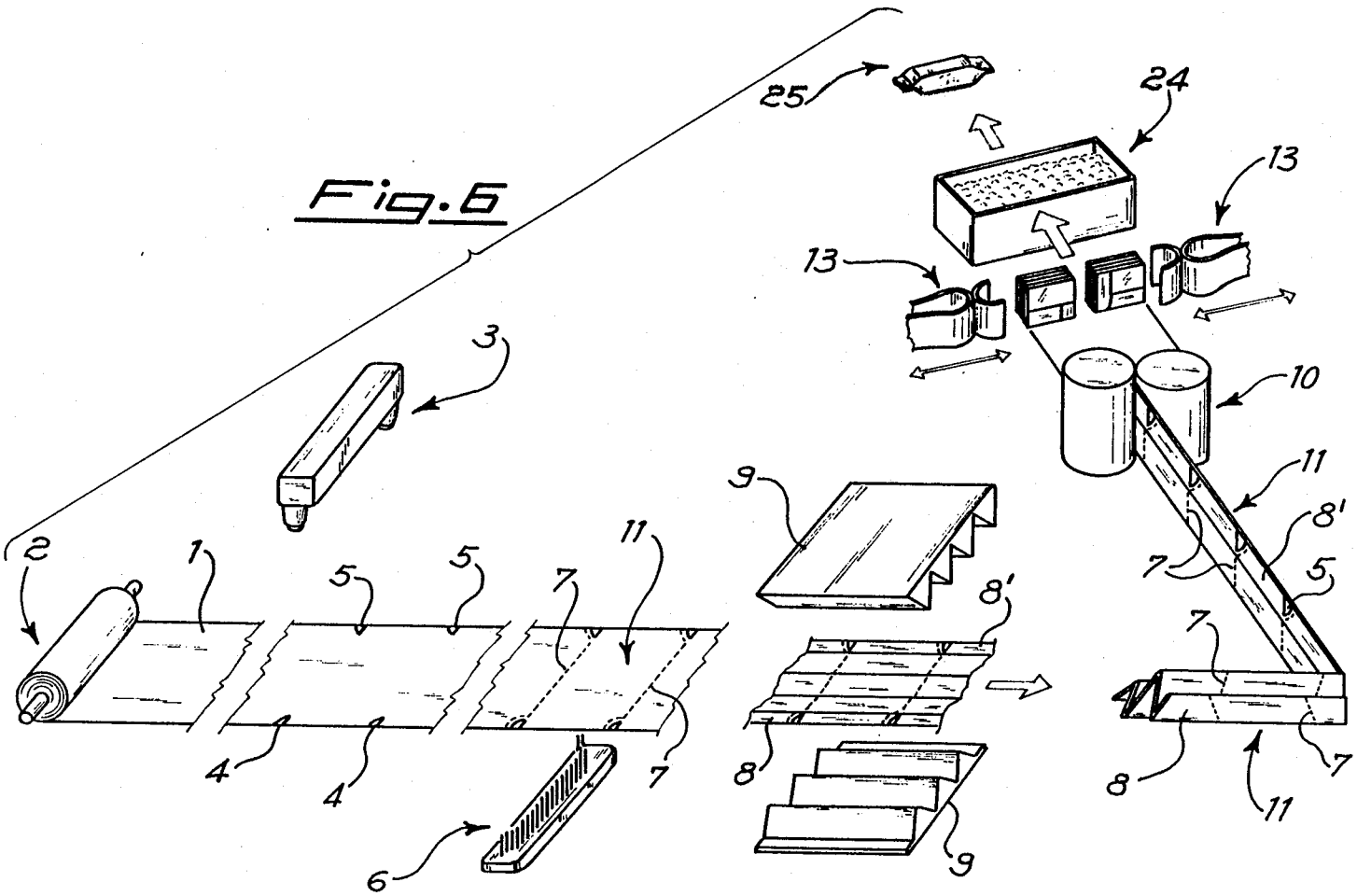
FIG. 6 is flow chart of a production process according to the invention.

Referring now to FIG. 1, a dispenser 31, provided with a dispensing slot 35 contains a stack of folded towels 34. As described in the previously cited European Patent Application No. 0126362, each towel 34 is folded with two horizontally superposed layers so that the edges of the towel, 36 and 38, are offset from each other. The edge 36 is overlying on the bottom layer of the folded towel 34, and is located in the area of the slot 35, while the bottom edge 38 is held by the rim of the slot itself.

Located on the towel area corresponding to the slot 35 area, there is a layer 37 of a rigid or semirigid, non adhesive material. In FIGS. 1 to 3 such layer 37 is positioned on the top face of edge 36, and is protruding from that edge, but it can obviously be positioned in any location on the towel slot area such as the one shown in FIG. 4, where the layer 37 is applied between edge 36 and the underlying part of edge 38. Alternatively said layer 37 can be positioned between the folds of edge 36.

Said layer 37 can be of any non adhesive, sufficiently rigid material, applied or inserted in the folded towel 34, such as, for example, a pressure adhesive label, a varnish, a thermoplastic material or a rigid or semirigid insert applied or glued to said towel area corresponding to the slot area.

In FIG. 5 is shown the slot area of a dispenser 40 according to the present invention. Through slot 45 it can be seen the upper edge 36 of a towel similar to those previously shown in FIGS. 1 to 3, also here provided with a rigid or semirigid layer 37. The container-dispenser 40 is made of a deformable material, such as a non-rigid plastic or the the like, so that by applying a pushing force to the bottom wall of said container the towel stack is positioned against the top wall, were the slot 45 is located. Thus the edge 36 is easily reached and the layer 37 helps to detach the edge 36 from the underlying part of the same towel 34, thus allowing an easy clutch of edge 36.

It should be noted that the slot 45 is obtained by partially die-cutting a portion 41 of the top wall of container 40. Portion 41 is die-cut, i.e. free, on three of its sides, while it is hinged to said top wall by means of the remaining fourth side 42.

To ensure an airtight closing of said slot 45 by the portion 41, a pressure adhesive strip 48 is located upon and around said die-cut portion 41. By pressing it, the strip 48 adheres to said top wall and keeps in place the portion 41, providing an airtight closing of slot 45.

In order to provide an easy grip of strip 48 during the slot 45 opening, which is accomplished by pulling said strip 48 from the top wall till the portion 41 is sufficiently removed from said slot 45, said strip 48 in provided with an end area which is not coated with the pressure-sensitive adhesive, and/or is protruding over a step 40' or a similar structure, positioned on the cited top wall.

The embodiments shown in FIGS. 1 to 3 all have a single layer 37; while this single layer is useful in extracting towel 34, it is less useful in unfolding the cited towel 34, and it has been noted that two layers could be more useful during said unfolding of said towel.

In FIG. 6 is shown a flow chart of a preferred method for the production of such a towel, which is later shown, unfolded, in FIG. 8.

Referring to FIG. 6, a bobbin 2 of a towel material web 1 is unwound and said web 1 is first led to an applier 3, known in itself, which covers two areas 4, 5 of the web 1 with a layer of a rigid or semirigid non-adhesive material, e.g. by applying a layer of varnish or the like. In FIG. 6 said areas 4 and 5 are positioned in the proximity of the opposed sides of web 1, but they can also be located in other positions. Each pair of covered areas 4, 5, is evenly spaced from the following or preceding pair of similar areas.

In another possible embodiment tis layer is not applied. Afterwards, the web 1 is die-cut by a discontinuous die-cutter 6 that forms a plurality of evenly spaced, preformed separation lines 7; such lines are located adjacent to the cited pairs of areas 4 and 5.

At this point of the production process, the web 1 is consisted of a series of outstretched towels 11, connected to each other by means of said preformed separation lines 7. The web 1 is then folded lengthwise, by the folding machine 9, in a plurality of parts (which in FIG. 6 are in the number of five); at least one of the more external ones of said parts is less wide than the remaining parts. In FIG. 1 example, both the external parts 8 and 8' are less wide than the remaining inner parts.

Figure 7:
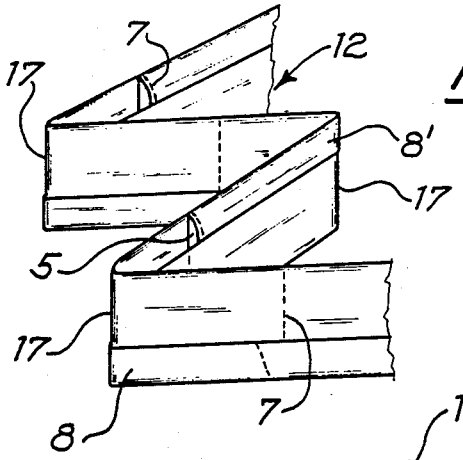
FIG. 7 is a perspective view of a step in FIG. 6 process

The thus lengthwise folded web is sent to a folder 10, of the kind having two counter-rotating rollers, which folds transversely in two portions having different length each towel 11. Said transverse folding is obtained by folding the web 1 in a zigzag fashion, in a way known in itself, by means of the roller folder 10. As better shown in FIG. 7, the zigzag folded web 1 is forming a plurality of straight layers 12, each having said preformed separation lines 7 in its middle area. Because of the different length of the transversely folded towel parts, the cited preformed separation lines 7 are not lined up, i.e. in four adjacent layers are lined up the separation lines of the first and of the third layer and those separation lines of the second and the fourth layer, respectively.

Going now back to the FIG. 1 and to the folded web 1, a plurality of packets with a preselected number of layers 12 are formed in a way known in itself, and each such packet is then divided in two other packets by separating the towels 11 along their preformed separation lines. In a preferred method said separation will be obtained by traction e.g. by the device schematically shown at 13 in FIG. 1.

Alternatively, said separation may be done also before or during the folding; e.g. by pairing to said folder 10 a device for controllably retaining the web 1 upstream said folder, so that the entering web is temporarily and alternatingly retained, while the web coming out from the folder 10 is subjected to a traction which causes the towels to separate along the separation lines 7.

The thus obtained packets are then imbued, at 24, with a disinfectant, deodorizing and/or detergent substances and eventually packages at 25.

Figure 8:
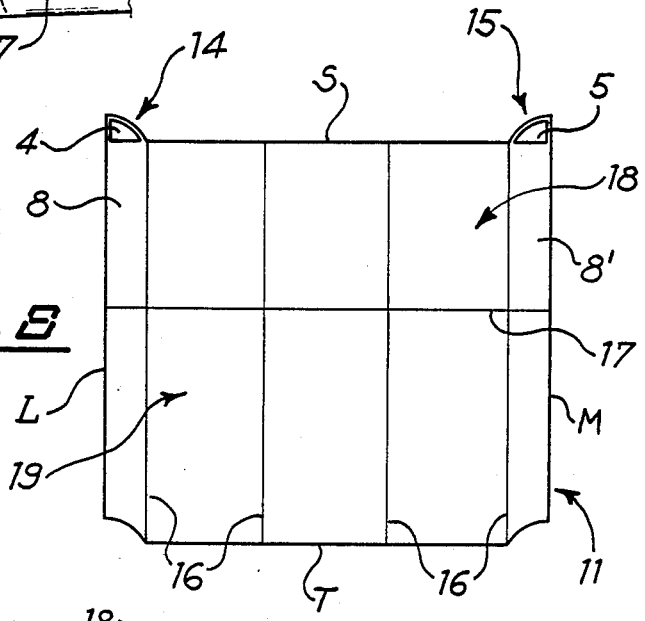
FIG. 8 is top view of a towel according to FIG. 6 production process.

In FIG. 8 is shown a preferred embodiment of a towel according to the invention. This towel is shown in an unfold, or "open" condition, and it can be noted that such a towel has two essentially rectilinear longitudinal sides L, M, which correspond to the web 1 edges, and two non-rectilinear transverse sides, T and S, which correspond to the preformed separation lines 7.

Side S is provided with two protruding parts 14, 15, forming the areas 4 and 5 on which the rigid or semirigid layer is applied. In FIG. 8 example said layer is applied on the same face of towel 11, but, obviously, it could be applied on the opposite towel faces.

Analogously, side S could be provided with only one protruding part, with or without said rigid or semirigid layer.

In FIG. 8 are also shown the longitudinal and transverse folding lines 16 and 17 respectively; in this preferred embodiment, lines 16 are forming two external parts 8, 8', both being less wide than the remaining inner parts. Thus, in the longitudinally folded towel, the protruding parts 14, 15 are located around the towel mid area.

As previously disclosed, by the transverse folding line 17 the longitudinally folded towel 11 is folded in two parts, 18 and 19, having different length. The protruding parts 14 and 15, forming the areas 4 and 5 respectively, are positioned on that part, 18 or 19, which is the shortest, i.e., in FIG. 8, on part 18.

Figure 9:
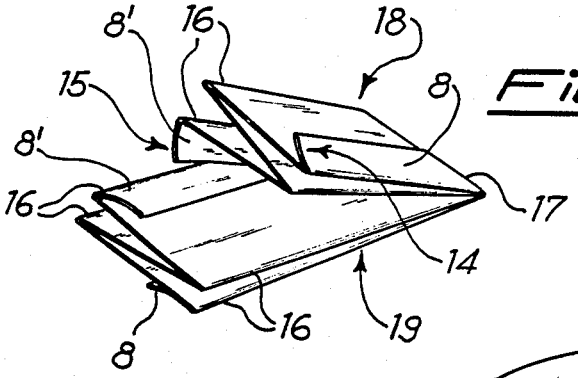
FIG. 9 is a perspective view of the FIG. 8 folded towel.

In FIG. 9 the towel 11 is shown folded both lengthwise and transversely along the previously cited folding lines. It should be noted that part 18, i.e. the shortest part formed by folding line 17, is positioned upon part 19.

Figure 10:
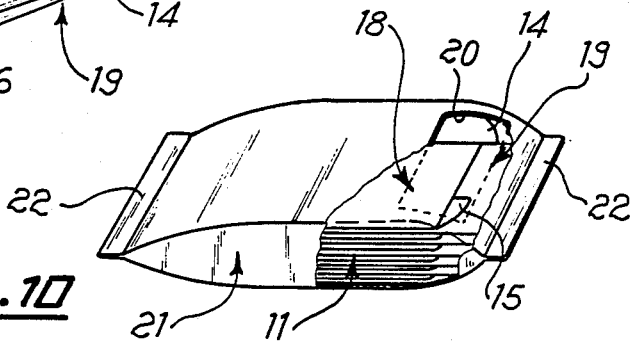
FIG. 10 is a perspective and partially sectional view of a container-dispenser according to the invention.

This location is essential when the towel 11 is positioned in the relating container-dispenser, as shown in FIG. 10, where the towels 11 are stacked in a container 21. On the top wall of said container 21, i.e. on the wall over and adjacent to towel part 18, is provided a dispensing slot 20; said slot 20 is parallel to the container short sides 22, and is positioned adjacent to one of said sides 22, so that the edge of towel part 18 is located in the slot area.

Slot 20 is airtightly closable by means of a device which in FIG. 10 is not shown but which is consisted of a partially die-cut portion of the container top wall and of a pressure-sensitive adhesive strip as the device previously shown in FIG. 5.

The protruding parts 14, 15 and the relating areas 4 and 5 are thus positioned, together with the towel part 18 edge, in the slot 20 area and can therefore be easily extracted from container 21.

Moreover, as said protruding parts are located on the opposed ends of the towel side S, each extracted towel 11 can be unfold in an "open" position as easily as it has been extracted from container 21.

I claim:

1. A disposable sanitary towel for storage in a container dispenser having a wall defining a slot area through which said towel dispensed, said towel being imbued with one or more substances selected from the group consisting of disinfectants, deodorizer and detergents, said towel being folded traversely, said traverse fold providing two horizontally superposed layers, the edges of which are offset from each other, wherein said towel is capable of being stacked independently in said container with one of said offset edges of the towel to be dispensed retained by said wall defining a slot area, and said other offset edge located in the slot area and provided with two protruding parts, said protruding parts being located on the same side of the open towel.

2. The disposable sanitary towel of claim 1 wherein said protruding parts include a layer of rigid or semi-rigid non-adhesive material thereon.

3. The disposable sanitary towel of claim 2 wherein said layer of rigid or semi-rigid non-adhesive material is selected from the group consisting of thermoplastic material and varnish.

4. The disposable sanitary towel of claim 1 wherein said towel is also folded lengthwise, said lengthwise fold providing a plurality of lengthwise fold layers, said protruding parts being located on separate ones of said plurality of lengthwise fold layers.

5. The disposable sanitary towel of claim 4 wherein said separate ones of said plurality of lengthwise fold layers comprise opposite faces thereof.

6. The disposable sanitary towel of claim 5 wherein said opposite faces comprise alternate lengthwise fold layers.

7. The disposable sanitary towel of claim 6 wherein said protruding parts include a layer of rigid or semi-rigid non-adhesive material thereon.

8. The disposable sanitary towel of claim 7 wherein said layers of rigid or semi-rigid non-adhesive material is selected for the group consisting of thermoplastic material and varnish.

* * * * *